United States Patent [19]

Barratt

[11] 3,939,804

[45] Feb. 24, 1976

[54] HELIUM HEATED BAYONET TUBE STEAM GENERATOR

[75] Inventor: Robert O. Barratt, Cedar Knolls, N.J.

[73] Assignee: Foster Wheeler Energy Corporation, Livingston, N.J.

[22] Filed: July 8, 1974

[21] Appl. No.: 486,286

[52] U.S. Cl. ..... 122/32; 122/319; 122/483; 165/142

[51] Int. Cl.[2] ..... F22B 1/06; F22B 21/00

[58] Field of Search ..... 122/32, 34, 483, 319; 165/142; 176/58, 59, 60

[56] References Cited

UNITED STATES PATENTS

| | | | |
|---|---|---|---|
| 3,076,443 | 2/1963 | Coles et al. | 122/34 |
| 3,090,433 | 5/1963 | Amorosi et al. | 122/32 |
| 3,097,630 | 7/1963 | Kinyon et al. | 122/34 |
| 3,110,288 | 11/1963 | Worley | 122/32 |
| 3,662,718 | 5/1972 | Creek et al. | 122/32 |

*Primary Examiner*—Kenneth W. Sprague
*Attorney, Agent, or Firm*—John E. Wilson; Marvin A. Naigur

[57] ABSTRACT

Water is heated to steam in bayonet tubes and the steam is superheated in bayonet tubes which are heated by helium and which extend from a single tube sheet in which there are no excessively large temperature gradients. Feed water enters the inner tube of a bayonet tube assembly so that it is heated in the annulus between the inner tube and its associated outer tube and then flows into the annular space between the inner and outer tube of a second bayonet tube assembly so that it is heated to steam to leave by the inner tube of the second bayonet tube assembly to then flow into the annular space between the inner and outer tubes of a third bayonet tube assembly to be superheated and leave the third bayonet assembly through the inner tube thereof.

11 Claims, 2 Drawing Figures

HELIUM HEATED BAYONET TUBE STEAM GENERATOR

BACKGROUND OF THE INVENTION

In some designs for nuclear power plants, water is heated to form superheated steam which is used to drive turbines which in turn provide the mechanical energy necessary to generate electricity. The water and steam are often flowed through helically coiled tubes which are heated by helium which has been used to cool a nuclear reactor. Helically coiled tubes have been used primarily because of their economy. The helical coils provide for a fairly large heat transfer surface within a relatively small space. Helium heated helical coil heat exchangers have have certain disadvantages. For one, it is difficult to inspect the walls of the tubes tube for defects after they have been in service. This is so because an inspection device cannot be easily passed through a coiled tube. Another disadvantage is due to the fact that if helical tubes are to be used in a heat exchanger where there are economizer, evaporator and superheater tubes, more than one tube sheet will be necessary in order to protect against large temperature gradients created by the difference in temperatures of the fluid entering and leaving the helical coils.

The disadvantages can be overcome to some extent by utilizing bayonet tubes in place of the helical coil tubes. Bayonet tubes can be inspected much more easily than helical coil tubes because inspection devices can be inserted and withdrawn quite easily. However, a heat exchanger using bayonet tubes will retain many of the dissadvantages found in a heat exchanger in which helical tubes are employed. For one, if tubes used for different phases of steam generation such as economizer tubes, evaporator tubes, and superheater tubes are connected to the same tube sheet, a large temperature gradient will result because of the different temperatures of the fluids flowing through the bayonet tubes and which exchange heat with the tube sheet. The use of several tube sheets makes for a design which requires a comparatively large amount of space and which is expensive to build.

SUMMARY OF THE INVENTION

It is an object of the present invention to overcome drawbacks found in the prior art such as those discussed above. Accordingly, an economizer bayonet tube assembly, evaporator bayonet tube assembly, and a superheater bayonet tube assembly are connected to a tube sheet positioned within a pressure vessel so that helium can be passed over the bayonet tube assemblies after having been used to cool a nuclear reactor and water can be flowed to the inner tube of the economizer bayonet tube assembly so that it will be heated as it flows between the inner and outer tubes of said economizer bayonet tube assembly, the water leaving said economizer bayonet tube assembly being directed into the space between the inner and outer tubes of the evaporator bayonet tube assembly so that it boils, the steam being formed flowing out through the inner tube of said evaporator bayonet tube assembly to flow into the space between the inner and outer tube of said superheater bayonet tube assembly to leave through the inner tube of the superheater bayonet tube assembly.

DETAILED DESCRIPTION OF THE PREFERRED EMBODIMENT

Figure 1:
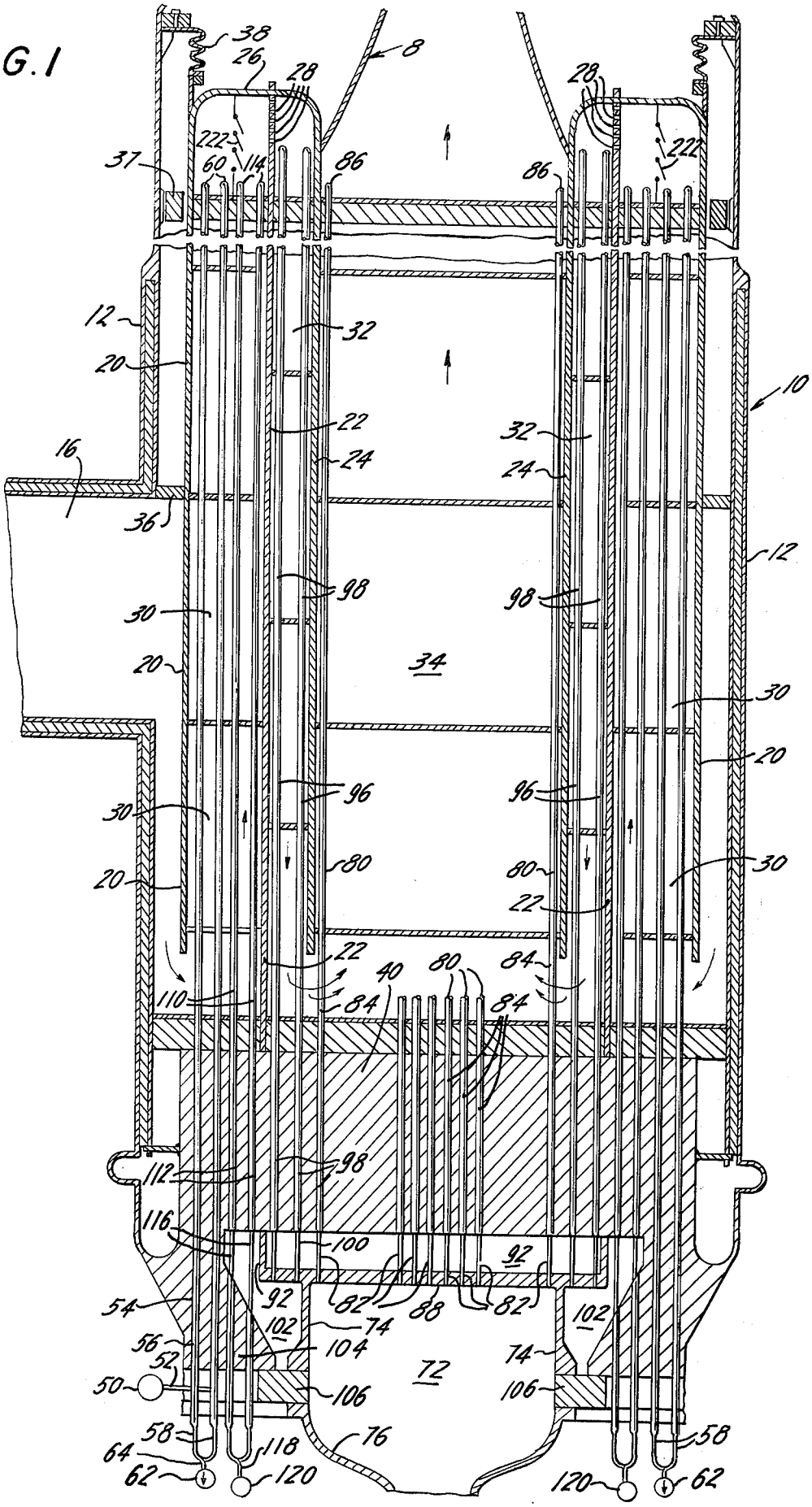
FIG. 1 is a front view, partly in section, showing a heat exchanger made in accordance with the present invention.

There is shown in FIG. 1 a steam generator indicated generally as 10 having an output shell 12 surrounded by concrete 14 and includes a helium intake 16 and a helium exhaust 18. An annular generally outer cylindrical flow shroud 20 is adjacent to the outer shell 12 and extends from a level adjacent to the top of the outer shell 12 to a location slightly lower than the helium intake 16. A middle flow shroud 22 is concentric with the outer flow shroud 20 and an inner flow shroud 24 is concentric with the outer and middle flow shrouds 20 and 22. The middle flow shroud 22 is of a smaller diameter than the outer flow shroud 20 and the inner flow shroud 24 is of a smaller diameter than the middle flow shroud 22.

An annular plate 26 extends over and connects with the tops of each of the flow shrouds 20, 22 and 24. A number of openings 28 in the upper portion of the middle flow shroud 22 permit helium to flow through the middle shroud immediately below the plate 26.

The outer flow shroud 20 and the middle flow shroud 22 define with the annular plate 26, an annular outer flow chamber 30 and the middle flow shroud 22 and the inner flow shroud 24 define with the annular plate 26, a middle flow chamber 32. The inner flow shroud 24 encircles a center flow chamber 34. Helium entering through the helium intake 16 cannot flow upward between the outer flow shroud 20 and the outer shell 12 because seal rings 36 and 37 are positioned between the outer flow shroud 20 and the outer shell 12 above the helium intake 16. Any helium escaping past the seal rings 36 and 37 will be blocked by the bellows seal 38 which brings the outer shroud 20 and the outer shell 12 at the upper portions thereof above the seal ring 36. A stagnant layer of helium will form between the outer shell 12 and the outer flow shroud 20 above the helium intake 16 and a flow of helium downward between the outer flow shroud 20 and the outer shell 12 will be created.

The helium flowing downward from the helium intake 16 will flow down against a tube sheet 40 which is positioned slightly below the bottom of the outer flow shroud 20. The tube sheet 40 is a member which along with the outer shell 20 functions to contain the helium, that is, the heating medium. The middle flow shroud 22 extends down to the tube sheet 40 so that helium flowing under the outer flow shroud 20 will reverse its direction to flow upward through the outer flow chamber 30 between the outer flow shroud 20 and the middle flow shroud 22. The helium will flow upward until it can rise no further because of the annular plate 26. The helium will then flow radially inward under the plate 26 through the flow openings 28 and into the middle flow chamber 32 between the inner flow shroud 24 and the middle flow shroud 22. Helium will then flow downward through the middle flow chamber 32 and since the inner flow shroud 24 does not extend down to the tube sheet 40, the helium will flow under the inner flow shroud 24 and radially inward to the central flow chamber 34 where it will flow upward to the helium exhaust 18 where it will leave the steam generator 10.

The helium flow then is generally a threepass flow, the first pass being upward through the outer flow chamber 30 then down through the middle flow chamber 32 and finally upward through the central flow chamber 34.

The present steam generator provides for the reheating of steam which enters through a steam line 50 which is connected to several tees 52. Each of the tees 52 is connected with one of a number of bayonet tube assemblies 54, each of which includes an outer tube 56 and an inner tube 58. The outer tubes 56 are each closed at their upper end at 60 and the tees allow the steam to enter the bayonet tube assemblies 54 in the annulii between the inner tubes 58 and the outer tubes 56. The steam will flow upward in the annulii until it can go no higher because of the closed ends 60 where it reverses direction to flow downward through the inner tubes 58 to a header 62 which connects with the inner tubes 58 by a thermal sleeve 64. The steam will be heated as it passes upwardly through the annulii between the outer tubes 56 and the inner tubes 58 by the hot helium gas which is flowing upward through the outer flow chamber 30. Preferably, the inner tubes 58 are insulated so that no heat will be lost by the steam passing down through them. The lower ends of the outer tubes 56 seal with the inner tubes 58 so that steam in the annulii between those tubes will not leak out.

The steam generator 10 also provides for the generation and superheating of steam from feed water. Feed water enters the steam generator 10 through a feed water inlet 70 which opens into a feed water chamber 72 below the tube sheet 40. The feed water chamber 72 is encircled by a cylindrical side wall 74 which is centrally located below the tube sheet 40 and an inwardly flared annular plate 76 which is connected at its top with the bottom of the wall 74. Economizer bayonet tube assemblies 80 each have an inner tube 82 and an outer tube 84, each of which is closed at its upper end 86. The upper portions of some of the economizer tube assemblies 80 are broken off for clarity in FIG. 1. The inner tubes extend down to an auxiliary tube sheet 88 which extends below the tube sheet 40 and which defines the top of the chamber 72. At the periphery of the auxiliary tube sheet 88, an annular vertical wall 90 joins the auxiliary tube sheet 88 to the tube sheet 40 to define a chamber 92. The outer tubes 84 extend downward only to the bottom of the tube sheet 40 and at their outer surfaces seal with the tube sheet 40 so that no fluid will pass between the outer tubes 84 and the tube sheet 40.

Feed water which has entered the feed water chamber 72 through the water inlet 70 will pass upward through the inner tubes 82, of the economizer bayonet tube assemblies 80, to the upper ends of the inner tubes 82 and then pass downward in the annulii between the inner tubes 82 and outer tubes 84 to the chamber 92. The feed water will be heated while passing downward through the bayonet tube assemblies 80 by helium flowing upward through the central flow chamber 34.

The water in the chamber 92 communicates with a plurality of evaporator bayonet tube assemblies 96 each of which includes an outer tube 98 and an inner tube 100. The outer tubes 98 are each connected with the tube sheet 40 in the same manner as are the outer tubes 84 of the bayonet tube assemblies 80. The inner tubes 100 extend down to the auxiliary tube sheet 88 where they are connected thereto outward of the vertical wall 74. Thus water from the chamber 92 will pass upward in the annulii between the outer tubes 98 and the inner tubes 100 and then pass downward through the inner tubes 100 to pass through the auxiliary tube sheet 88. As the water passes upward, it will be heated by helium passing downward through the middle flow chamber 32 and changed into steam. The steam coming out of the inner tubes 100 passes into a steam chamber 102 which is defined by a marginal edge portion 104 of the tube sheet 40 which projects downward and inward, the auxiliary tube sheet 88, annular vertical walls 74 and 90 and a ring 106 which seals off the bottom of the steam chamber 102.

Steam from the steam chamber 102 then passes through superheater bayonet tube assemblies 110. The superheater bayonet tube assemblies 110 each have an outer tube 112 closed at its upper end 114 and an inner tube 116. The outer tubes 112 are connected with the tube sheet 40 in a manner similar to the outer tubes of the bayonet tube assemblies 80 and 96. The inner tubes project downward and through the marginal edge portion 104 to thermal sleeves 118 which connect to an outlet header 120. The superheated steam is then piped to a point where it is used, for example, in a high pressure turbine.

Figure 2:
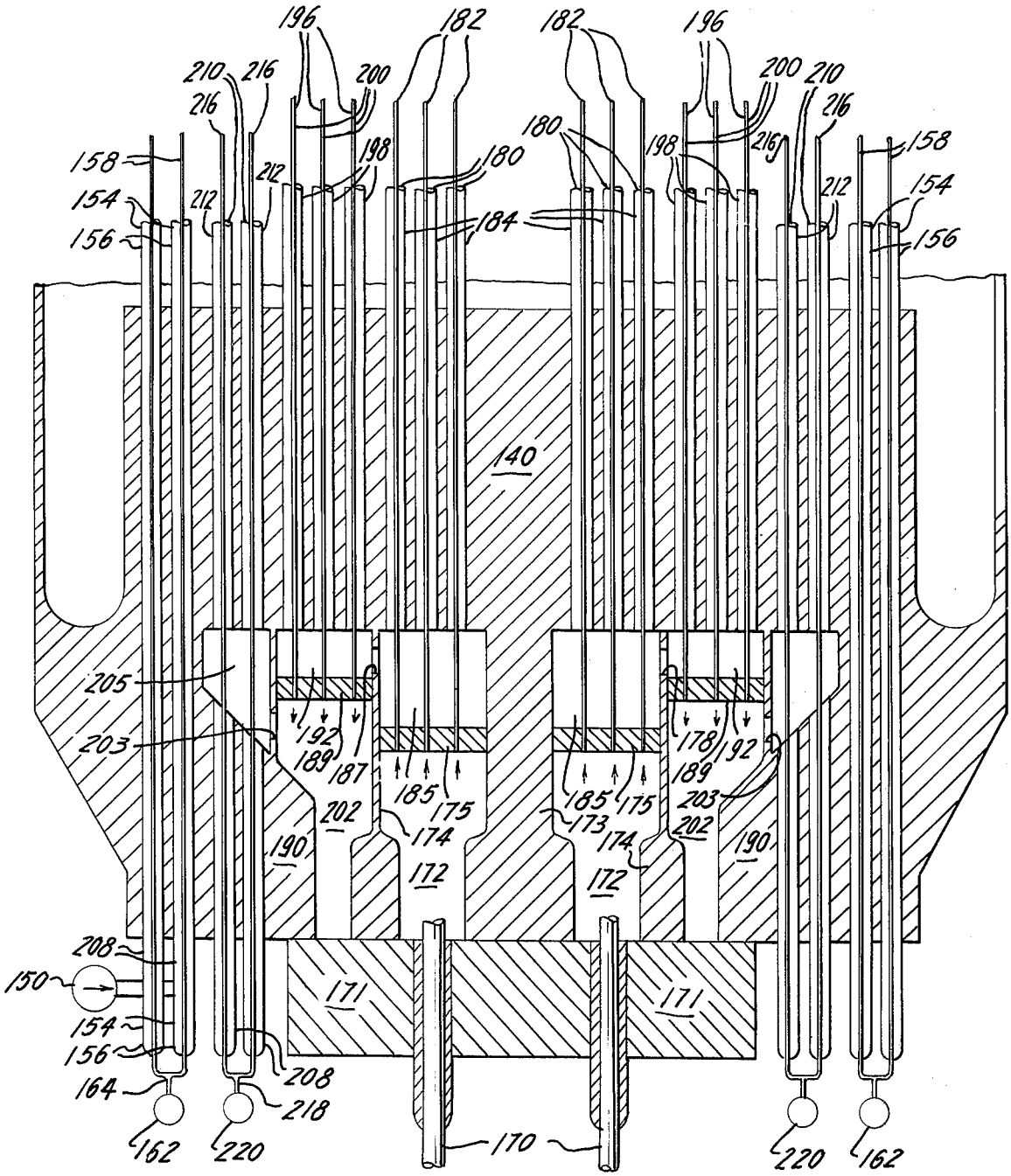
FIG. 2 is a view, partly in section, showing a modification of the structure in the vicinity of the tube sheet of the heat exchanger shown in FIG. 1.

FIG. 2 is a view showing a modification in the vicinity of the tube sheet 40 of the steam generator of FIG. 1. In the embodiment of FIG. 2 anything now shown in FIG. 2 is identical to the embodiment of FIG. 1. FIG. 2 shows a main tube sheet 140, a steam line 150 which is connected to a number of tees which connect with reheater bayonet tube assemblies 154, each of which extend through the main tube sheet 140 and each of which has an outer tube 156 and an inner tube 158. The inner tubes are connected with a header 162 through a thermal sleeve 164 as shown. The bayonet tube assemblies 154 and the inner and outer tubes thereof function in the same way as the bayonet tube assemblies 54 and the inner and outer tubes 58 and 56 shown in FIG. 1.

Two feed water inlets 170 in a generally circular plate 171 directs feed water into feed water chambers 172 each of which is defined by a central column 173, an annular vertical wall 174 and an auxiliary annular tube sheet 175. The water then flows through several economizer bayonet tube assemblies 180 each having an inner tube 182 and an outer tube 184. The outer tubes 184 extend downward only to the bottom of the tube sheet 140 but the inner tubes extend down to the auxiliary tube sheet 175 so that feed water will pass up through the inner tubes and be heated as it passes downward through the annulii between the inner tubes 182 and the outer tubes 184. The hot water will collect in the annular collection chamber 185 above the auxiliary tube sheet 175. Openings 187 in the vertical wall 174 allow the water to flow outward and over an annular auxiliary tube sheet 189 which bridges between the vertical wall 174 and a concentric annular vertical wall 190. The vertical walls 174 and 190 and the auxiliary tube sheet 189 define a water chamber 192 below the tube sheet 140. The water flowing into the chamber 192 will then flow through a plurality of evaporator bayonet tubes assemblies 196 by passing first through the annulii between outer tubes 198 and inner tubes 200 to be heated and generated into steam. The chamber 185, openings 187, and the chamber 192 define a first conduit which serves as a means for placing the economizer bayonet tube assemblies 180 in communication with the evaporator bayonet tube assemblies 196. The steam then passes downward through the inner tubes 200 and into a steam chamber 202. The steam chamber 202 which is defined by the walls 174 and 190 as well as the auxiliary tube sheet 189 and the plate 171 is not completely closed because of the presence of an opening 203 in the vertical wall 190. Steam from the chamber 202 will pass through the openings 203 and then enter a chamber 205 within the tube sheet 140 laterally outward of the vertical wall 190. The steam then communicates with a plurality of superheater bayonet tube assemblies 210 each of which has an outer tube 212 and an inner tube 216. The chamber 202, openings 203 and chamber 205 define a second conduit. The second conduit serves as a means for placing the evaporator tube assemblies 196 in communication with the superheater tube assemblies 210. The outer tubes are secured to the main tube sheet 140 above the chamber 205, whereas the inner tubes 216 extend down through the chamber 205 and into end caps 208. The steam which passes into the chamber 205 passes up through the annulii between the inner tubes 216 and the outer tubes 214. It then flows downward through the inner tubes 216 to thermal sleeve 218 which connects with a steam header 220.

The advantage of the structure shown in FIG. 2 over the structure shown in FIG. 1 is not one of operation but an advantage of structural rigidity which allows the use of a thinner tube sheet. This is due to the three vertical walls which define the chambers 172, 202 and 205. In the embodiment of FIG. 1 only one vertical wall 74 is present and it does not support the tube sheet 40 directly but only through the auxiliary tube sheet 38 and the annular vertical wall 90.

Typically, the feed water coming in the economizer section will be between 600°F. and 700°F. In the present invention it passes through the tube sheet while contacting the outer tubes of the economizer section. The water, which is brought close to the boiling point, then passes through the evaporator bayonet tubes in the annulii between the inner and outer tubes at only a slightly higher temperature than the feed water. In these tubes the water is generated into steam which is only slightly superheated. The steam then passes to the superheater section to pass between the inner and outer tubes of the superheater bayonet tubes. Here the temperature of the steam is raised considerably but it passes through the tube sheet through the inner tubes of the superheater bayonet tube assemblies so that no heat is transferred from the superheated steam to the tube sheet. Thus, with the present design the fluids which transfer heat with the main tube sheet are always within a relatively small temperature range. Therefore, there will be no substantial temperature gradients across the main tube sheet. The absence of temperature gradients will prevent the failures concomitant with large temperature gradients in the presence of intake tube sheets.

The present heat exchanger also includes a reheater section in which the steam to be reheated passes through bayonet tubes between the inner and outer tube sheets at a temperature fairly close to the feed water, the water heated in the economizer section and the unsuperheated steam which exchange heat with the tube sheet. Thus, even with the reheater section there will be no excessive temperature gradient at the tube sheet.

In both embodiments the reheater and superheater sections are both located within the same helium flow chamber 30 so that available heat can be allocated between these two sections. To that end a series of dampers 222 (FIG. 1) are provided between the upper ends of the bayonet tube assemblies which make up the reheater and superheater sections. By adjusting the dampers 222 the flow of hot helium can be divided between the two sections selectively for optimum efficiency.

The use of a single main tube sheet allows for easy maintenance because each of the bayonet tube assemblies can be reached from one side of the main tube sheet without dismantling any thick tube sheets. This is advantageous when it is desired to radiologically inspect the tubes after a period of operation.

Another advantage found in having each of the bayonet tubes connected with a single main tube sheet is that after a period of operation it is often necessary to change the heat transfer area in one of the sections. A change in heat transfer area is often necessitated by a greater change in average wall thickness in the tubes of one section than in the tubes of another section due to erosion or corrosion removal. Often tubes must be plugged in order to avert leakage and this will change the effective heat transfer area of the associated section.

Typically, the heat transfer area is trimmed by removing a section of the inner tube of one or more bayonet tube assemblies in the section in which it is desired to reduce the effective heat transfer area. In the present design it is a comparatively simple matter to remove a small section of an inner tube because access can be had to each inner tube below the main tube sheet.

Further, the use of a single tube sheet permits the placement of all of the headers and piping necessary for the water and steam below the tube sheet where it can be more easily reached for maintenance.

The present invention permits the incorporation of reheater tubes without requiring the additional space and structure which are usually required when a reheater is included within the outer shell of a steam generator of this type. Setting the reheater around the superheater using the downward projecting marginal edge portion 104 permits the addition of reheater without introducing a significant enlargement in the size of the steam generator.

The foregoing describes but one preferred embodiment other embodiments being possible without exceeding the scope of the present invention as defined in the following claims.

What is claimed is:

1. A helium heated steam generator comprising:

an outer shell;

a helium intake in said outer shell;

a helium exhaust in said outer shell;

a main tube sheet in said outer shell;

a plurality of economizer bayonet tube assemblies extending upward from said main tube sheet;

a plurality of evaporator bayonet tube assemblies extending upward from said main tube sheet;

a plurality of superheater bayonet tube assemblies extending upward from said main tube sheet;

each of said bayonet tube assemblies having an inner tube and a coaxial outer tube of larger diameter, said outer tubes having closed upper ends and being connected with said main tube sheet, said inner tubes extending below said main tube sheet;

a feed water inlet for supplying fluid to said economizer bayonet tube assemblies;

first conduit means permitting communication between said economizer bayonet tube assemblies and said evaporator bayonet tube assemblies;

second conduit means permitting steam leaving said evaporator bayonet tube assemblies to flow into the annular space between the inner and outer tubes of said superheater bayonet tube assemblies; and a steam outlet through said shell connected with the inner tubes of said superheater bayonet tube assemblies;

whereby when hot helium gas is flowed through said helium intake over said outer tubes and out of said helium exhaust, and feedwater is flowed through said feedwater inlet, and said economizer bayonet tube assemblies to said evaporator bayonet tube assemblies and steam flows from said evaporator bayonet tube assemblies through said superheater bayonet tube assemblies and through said steam outlet, steam will be superheated in said superheater bayonet tube assembly while flowing upward in the space between said outer and inner tube of said superheater bayonet tube assemblies and leave said superheater bayonet tube assemblies by said inner tubes of said superheater bayonet tube assemblies.

2. The steam generator defined in claim 1 wherein said second conduit means permits the steam leaving said evaporator bayonet assemblies to leave from said inner tubes of said evaporator bayonet tube assemblies.

3. The steam generator defined in claim 2 wherein saifirst conduit means permits communication between the annular spaces between said inner and outer tubes of said economizer bayonet tube assemblies and said spaces between said inner and outer tubes of said evaporator bayonet tube assemblies.

4. The steam generator defined in claim 1 further comprising:

a plurality of reheater bayonet tube assemblies, said reheater bayonet tube assemblies each having an inner tube, and a coaxial outer tube connected to the main tube sheet adjacent its bottom and closed at its upper end, a steam line connected with the space between said inner tube and outer tube of said reheater bayonet tube assembly for admitting steam to be reheated so that reheated steam leaves said reheater bayonet tube assemblies through the lower ends of said inner tubes thereof.

5. The steam generator defined in claim 4 further comprising a damper positioned between said reheater and superheater assemblies for regulating the flow of helium gas over said reheater and superheater assemblies.

6. A helium heated steam generator comprising:

an outer shell;

a helium intake in said outer shell;

a helium exhaust in said outer shell;

a main tube sheet extending horizontally within said outer shell;

a plurality of evaporator bayonet tube assemblies extending upward from said main tube sheet;

a plurality of superheater bayonet tube assemblies extending upward from said main tube sheet;

each of said bayonet tube assemblies having an inner tube and a coaxial outer tube of larger diameter, said outer tubes each having a closed upper end and being connected adjacent the lower end thereof with said main tube sheet, each of said inner tubes extending below said main tube sheet;

means for supplying water to the annular spaces between the inner and outer tubes of said evaporator bayonet tube assemblies so that said water will flow upward to be transformed into steam when hot helium gas from said helium intake is flowing over said evaporator bayonet tube assemblies;

means for flowing steam leaving the bottoms of said inner tubes of said evaporator bayonet tube assemblies to the spaces between said inner and outer tubes of said superheater bayonet tube assemblies so that the steam from said evaporator bayonet tube assemblies will flow upward in the annular spaces between the inner and outer tubes of said superheater bayonet tube assemblies to be superheated by heat supplied by said helium gas flowing over said superheater bayonet tube assemblies; and means to flow the superheated steam leaving the lower ends of said inner tubes of said superheater bayonet tube assemblies out of said shell.

7. The helium heated steam generator defined in claim 6 further comprising:

a plurality of economizer bayonet tube assemblies extending upward from said main tube sheet, each of said economizer bayonet tube assemblies having an inner tube and a coaxial outer tube of larger diameter, said outer tubes having a closed upper end and being connected with said main tube sheet, said inner tubes extending below said main tube sheet;

means to flow feedwater upward through said inner tubes of said economizer bayonet tube assemblies so that the feedwater will flow downward through the annular spaces between said inner tubes and said outer tubes of said economizer bayonet tube assemblies to be heated by said helium gas flowing in said shell; and wherein said means for supplying water to said annular spaces between the inner and outer tubes of said evaporator bayonet tube assemblies receives water from said economizer bayonet tube assemblies.

8. The helium heated steam generator defined in claim 7 further comprising; an outer flow shroud, said outer flow shroud being generally cylindrical, within said outer shell and encircling said superheater bayonet tube assemblies, a middle flow shroud and an inner flow shroud, said middle flow shroud and said inner flow shroud each being cylindrical and concentric with said outer flow shroud, said inner flow shroud having a smaller diameter than said middle flow shroud and said middle flow shroud having a smaller diameter than said outer flow shroud, whereby helium will flow upward between said outer flow shroud and said middle flow shroud, downward between said inner flow shroud and said middle flow shroud and upward within said inner flow shroud, said helium exhaust being located above said inner flow shroud so that the helium leaving the space within said inner flow shroud can leave said helium heated steam generator; said economizer bayonet tube assemblies extending within said inner flow shroud; said evaporator bayonet tube assemblies extending between said inner flow shroud and said middle flow shroud and said superheater bayonet tube assemblies extending between said middle flow shroud and said outer flow shroud.

9. The helium heated steam generator defined in claim 8 further comprising; a plurality of reheater bayonet tube assemblies, each of said reheater bayonet tube assemblies having an inner tube and a coaxial outer tube of larger diameter, said outer tubes of said reheater bayonet tube assemblies having closed upper ends and being connected with said main tube sheet, said reheater bayonet tube assemblies being positioned within said outer flow shroud, means to flow steam to be reheated upward through the annular spaces between said inner tubes of said reheater bayonet tube assemblies and said outer tubes of said reheater bayonet tube assemblies so that the upward flowing steam will be reheated by hot helium gas and the reheated steam will flow downward through said inner tubes of said reheater bayonet tube assemblies and subsequently out of said helium heated steam generator.

10. The helium heated steam generator defined in claim 9 wherein said reheater bayonet tube assemblies are spaced outward of said superheater bayonet tube assemblies within said outer shroud and further comprising; a plurality of dampers positioned between said reheater bayonet tube assemblies and said superheater bayonet tube assemblies to allocate the helium gas flowing between said middle shroud and said outer shroud between said reheater bayonet tube assemblies and said superheater bayonet tube assemblies.

11. The helium heated steam generator defined in claim 10 wherein said inner tubes of said evaporator bayonet tube assemblies extend down to and are connected with an auxiliary tube sheet extending horizontally below said main tube sheet so that water coming from said economizer bayonet tube assemblies will flow to the space between said auxiliary tube sheet and said main tube sheet and then upward in the annular spaces between said inner tubes of said evaporator bayonet tube assemblies and said outer tubes of said evaporator bayonet tube assemblies and the steam leaving the inner tubes of said evaporator bayonet tube assemblies will flow below said auxiliary tube sheet and subsequently to the annular spaces between said inner tubes of said superheater bayonet tube assemblies and said outer tubes of said superheater bayonet tube assemblies.

* * * * *